United States Patent [19]

Huth, III

[11] Patent Number: 4,523,170

[45] Date of Patent: Jun. 11, 1985

[54] ADJUSTABLE AIR GAP FERRITE STRUCTURES AND METHODS OF MANUFACTURE

[75] Inventor: Joseph F. Huth, III, Butler, Pa.

[73] Assignee: Spang & Company, Butler, Pa.

[21] Appl. No.: 439,370

[22] Filed: Nov. 5, 1982

[51] Int. Cl.[3] ..... H01F 21/06

[52] U.S. Cl. ..... 336/83; 29/608; 264/67; 336/136

[58] Field of Search ..... 29/602 R, 607, 608, 29/606; 264/67, DIG. 58; 336/83, 130, 132, 134, 135, 136, 233, 200; 338/87

[56] References Cited

U.S. PATENT DOCUMENTS

| | | | |
|---|---|---|---|
| 2,822,600 | 2/1958 | Scott | 267/67 X |
| 2,905,913 | 9/1959 | Leigh | 336/83 |
| 3,092,796 | 6/1963 | Maeda | 336/135 |
| 3,103,642 | 9/1963 | Fuller | 338/87 |
| 3,254,319 | 5/1966 | Olsen et al. | 336/83 X |
| 3,267,401 | 8/1966 | Hotine et al. | 336/136 |
| 3,313,017 | 4/1967 | Zinaali | 29/606 |
| 3,833,872 | 9/1974 | Marcus et al. | 336/200 X |
| 3,944,958 | 3/1976 | Postma | 336/83 X |
| 4,054,855 | 10/1977 | Schlotterbeck | 336/136 X |
| 4,150,278 | 4/1979 | Resener | 336/83 X |

FOREIGN PATENT DOCUMENTS

| | | | |
|---|---|---|---|
| 754576 | 5/1953 | Fed. Rep. of Germany | 336/136 |
| 1226225 | 10/1966 | Fed. Rep. of Germany | 336/83 |
| 2344372 | 3/1975 | Fed. Rep. of Germany | 336/83 |
| 1400837 | 12/1965 | France | 336/83 |
| 1431710 | 2/1966 | France | 336/83 |
| 1286474 | 8/1972 | United Kingdom | 336/83 |

*Primary Examiner*—Thomas J. Kozma
*Attorney, Agent, or Firm*—Raymond N. Baker

[57] ABSTRACT

New fabricating methods and products are disclosed for manufacture and assembly of tunable-inductance magnetically-soft ferrite core assemblies. Pot core type elements are pressure molded from ferrimagnetic particles having residual reactivity; unitary helical threads are tapped in central openings of compacted core elements while in the green state; subsequent heat treatment converts the green compact to a ceramic. Use of a shrink tap provides compatibility of the unitary threads with the pre-threaded male adjustment members of the prior practice. A new assembly enables use of identical core half sections; provision is made for support at one or both longitudinal ends of the male tuning member.

3 Claims, 9 Drawing Figures

FIG. 1 PRIOR ART
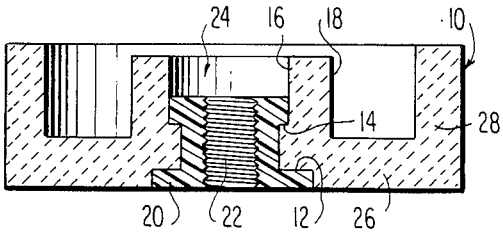
FIG. 2 PRIOR ART
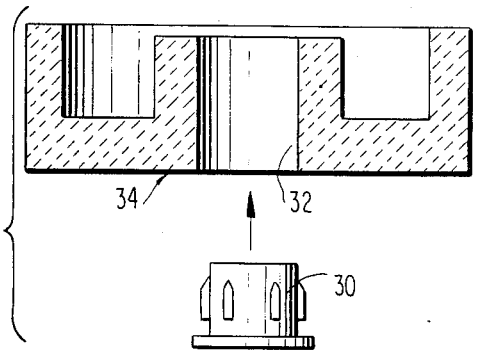
FIG. 3
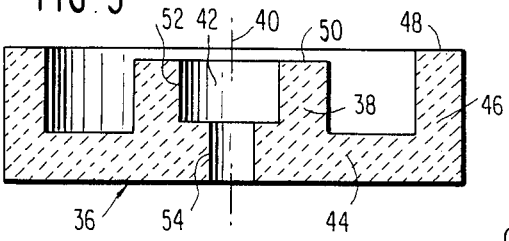
FIG. 4
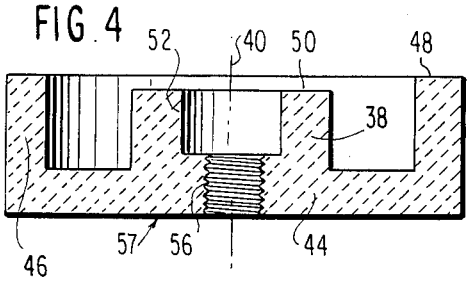
FIG. 6
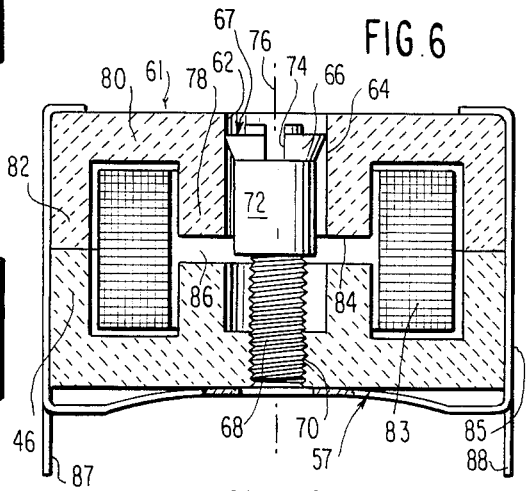
FIG. 5
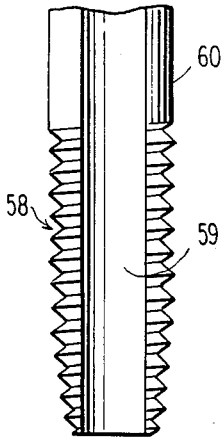
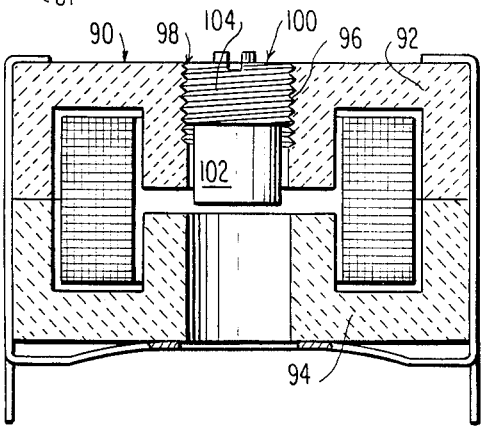
FIG. 7

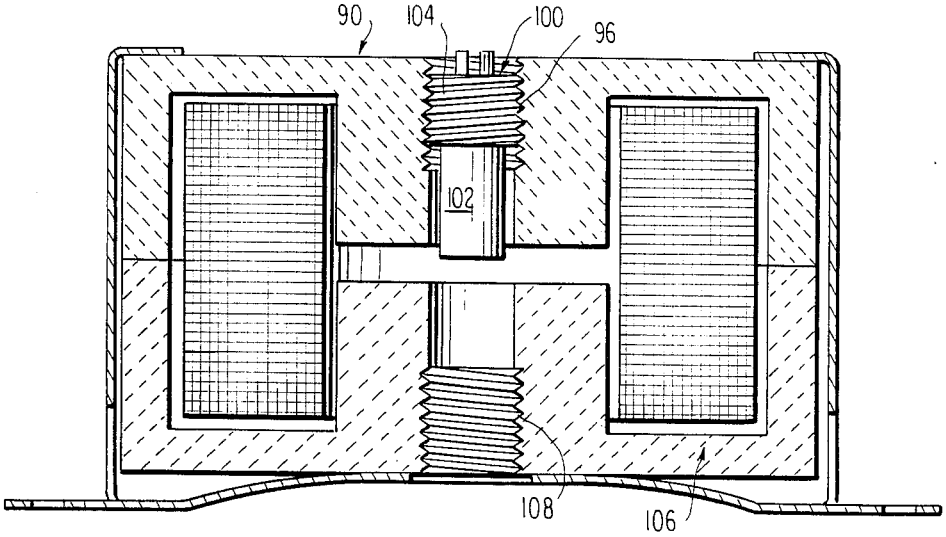
FIG. 8
FIG. 9
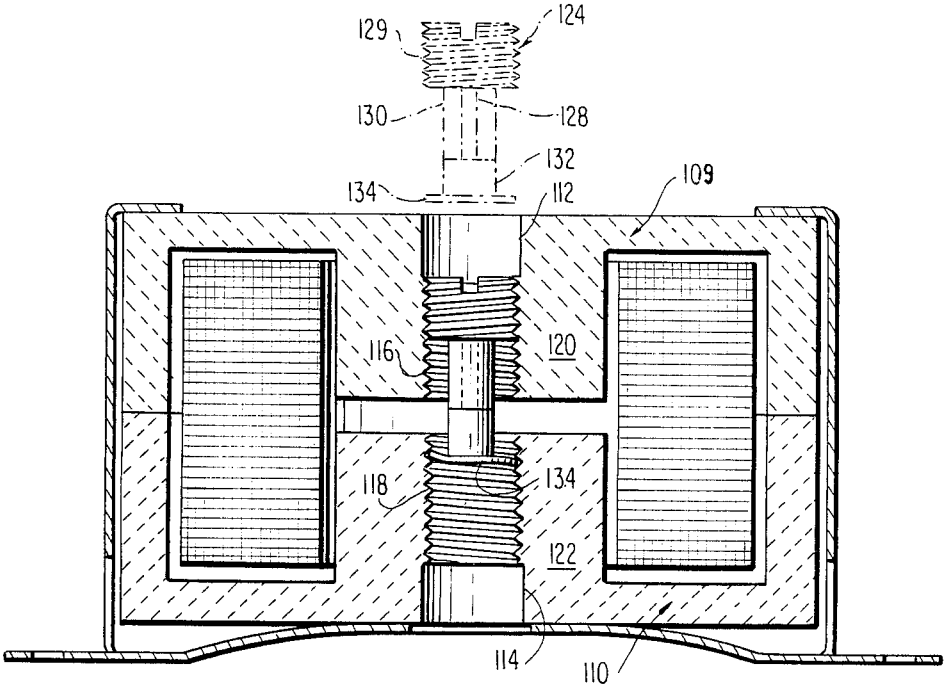

ADJUSTABLE AIR GAP FERRITE STRUCTURES AND METHODS OF MANUFACTURE

This invention relates to magnetically-soft ferrites, and more particularly to new adjustable inductance devices and to new manufacturing methods for ferrite core elements.

Coil windings for an electrical inductance device used in various high frequency applications are mounted within a ferrite core assembled from two core elements which are substantially identical half sections of the core. Such elements are assembled with selected mating surfaces in contact to provide a desired magnetic path for flux resulting from current changes in the coil windings. Each core element includes a center post, a radially extending web at one longitudinal end of the post, and an outer wall skirt portion extending in spaced parallel relation to the center post. When such core elements are assembled, their center posts cooperate to provide a central support for a coil bobbin which places the coil windings within the space defined between the central support and the skirt portions of the. core elements. The skirt portions are provided with mating surfaces in direct engagement to provide a substantially continuous flux path.

In certain applications, especially in telecommunications circuitry, the center posts of the two core elements have their opposed inner ends in longitudinally spaced relationship to provide an air gap for controlling the inductance of the coil; such adjustable air gap devices are generally referred to as pot core types. The present invention contributes methods and means which provide for accurate and reliable adjustment of a pot core air gap more economically than methods and means available in the prior art.

Cylindrical openings through the center post portions of the core selections have been provided for movement of a ferrite plunger for adjusting the air gap. In commercial practice, a ferrite tuning member is supported on a non-magnetic shaft member having external threads which engage a nonmagnetic internally-threaded sleeve which has been fitted into the central opening of one of the ferrite core elements. The separately-formed nonmagnetic sleeve has been fabricated to the internal contour of the central opening or installed by interference fitting and/or cementing to the central opening of the ferrite core element.

The present invention teaches a new approach which reduces the number of handling and manufacturing steps while maintaining adjustment standards of the prior practice.

More specific contributions and advantages of the invention will be considered in the description associated with the accompanying drawings, in which:

FIG. 1 is a cross-sectional view of a prior art magnetic core element with injection-molded internally-threaded sleeve;

FIG. 2 is a view, partially in cross section, of prior art structure with an internally threaded sleeve to be glued and/or press fitted into the core part;

FIG. 3 is a cross-sectional view of a core part during manufacture in accordance with the invention;

FIG. 4 is a cross-sectional view of a core element during manufacture in accordance with the invention;

FIG. 5 is an elevational view of tapping apparatus used in the present invention;

FIG. 6 is a cross-sectional view of an adjustable inductance device embodying the invention;

FIG. 7 is a cross-sectional view of an adjustable inductance device embodying the invention;

FIG. 8 is a cross-sectional view of an adjustable inductance device embodying the invention; and FIG. 9 is a cross-sectional view of an adjustable inductance device embodying the invention showing the male tuning member before and after assembly The prior commercial practice, as shown in FIGS. 1 and 2, required pre-assembly of a separately-formed, non-magnetic, internally-threaded sleeve (female member) into a base core element. The complete ferrite core included two core elements (half-core sections) and a ferrite tuning slug carried by a threaded male member which was directed axially into the central opening of one section; external threads on the male member coact with internal threads of the separately-formed sleeve for axial adjustment of the ferrite slug.

Referring to FIG. 1, core element 10 was molded with flange holding surfaces 12 and 14 arranged along center opening wall 16 of center post 18. A plastic sleeve 20, with internal threads, was injection-molded, after sintering of the core part, within opening 24 at the longitudinal end of center post 18 from which web 26 extends toward skirt 28. Sleeve 20 was rigidly held by the special contouring along the central opening of the core element. But, the multiple-handling steps considerably increases manufacturing costs; also, parts damaged in the process and improperly formed sleeves decreases the yield of commercially acceptable product.

In the commercial practice illustrated in FIG. 2, a sleeve 30 with internal threads (not shown) was cemented and/or press fitted into the central opening 32 after sintering of the core part. Disadvantages of this approach include breakage of the core parts during press fitting. Also, adhesives can detrimentally affect magnetic properties of adjacent ferrite material, can contaminate the internal thread during assembly, and are subject to deterioration under the changing conditions encountered in operation of an electrical inductance device.

The present invention provides a unitary core element with threads for receiving a male tuning member established along its central axially directed opening. Referring to FIG. 3, a unitary compact 36 is molded at elevated pressures from a single mass of substantially homogeneous ferrite-forming material of preselected composition provided in particulate form; such ferrimagnetic material maintains a desired degree of residual reactivity after pressure molding into a green compact.

The part is molded with an elongated center post 38 which is symmetrical about centrally located axis 40; center post 38 defines a central opening 42 symmetrical about such axis. Web 44 extends in a direction transverse to axis 40 toward skirt 46. It should be noted that surface 48 at the distal end of skirt 46 is at a differing level axially than surface 50 at the distal end of center post 38.

The invention teaches the formation of threads on the interior wall of the green-molded part, e.g. by a tapping operation from one longitudinal end of the central opening. The compact with unitary threads is then heat treated at elevated temperatures to form a hard ceramic ferrite part.

In the embodiment of FIG. 3, center hole 42 is defined by two interior wall portions 52 and 54 which are differently spaced from the central axis 40 and define differing diameter cylindrical surfaces in center opening 42 but without any requirement for a holding flange configuration as in FIG. 1.

In general pot cores are molded with circular cross-sectional configurations for the skirts, the outer diameter of center posts, and central openings. However, concepts of the present invention can be used with other cross-sectional configurations for the skirts and center posts; e.g., a so-called "slab-sided" core can be made in which diametrically opposite skirt segments are rectilinear rather than curvilinear; also, "square cores" can be made in which the axially transverse cross section is rectangular.

After pressure molding of green compact 36, and before sintering, threads 56 (FIG. 4) are tapped into wall portion 54 of green compact forming core part 57 to provide pot core elements capable of accommcdating male tuning members of the prior art.

Such threads are tapped using a tapping tool of the type shown in FIG. 5 including thread cutting portions such as 58, separated by axially open flutes 59; a counterbore cutting surface 60 can be provided at the supported end of the tapping tool.

The internally threaded part is then sintered at elevated temperatures such that the raw ferrimagnetic material reacts to form a hardened ceramic part. During such reaction, the ferrimagnetic material shrinks. In accordance with present teachings, the dimensions of threads 56 are controlled during tapping of green compact 36 to compensate for such shrinkage.

Shrinkage during sintering can vary between about 10% and 20% dependent on the integrated effect of a number of factors. Control of shrinkage and the tapping operation establish threads in the sintered product 57 within a $\pm 1\%$ tolerance level so as to be compatible with male tuning members fabricated with threads to industry standard specifications.

Factors which are taken into account in predetermining shrinkage and dimensions of the threads formed in green compact 36 include: the composition of the material, the calcining operation which determines residual reactivity maintained of the material, the density of compaction, and the times, temperatures and atmospheres utilized during the sintering operation. Representative shrinkage values for specific ferrite compositions are available to those skilled in the art.

Substantially the same green material is used in manufacturing another core part 61 (FIG. 6) for use with the sintered core part 57. In compacting core part 61, center opening 62 of the embodiment of FIG. 6 is molded to present cylindrical wall 64 having an interior diameter for accommodating head 66 of the male tuning member 67.

The male tuning member 67 includes a nonmagnetic shaft 68 with threads 70; a ferrite tuning sleeve 72 is secured in the position shown to shaft 68 above threads 70. Head portion 66 includes a tool slot such as 74. The male tuning adjustment member 67 is symmetrical about central longitudinal axis 76 of the FIG. 6 assembly.

Core part 61 includes center post 78 which defines central opening 62, web 80 which extends transversely from the outer longitudinal end of center post 78, and skirt 82 which extends in an axial direction from web 80 in substantially parallel relationship to center post 78.

In the assembled core, the distal ends of skirts 46 and 82 are in direct contact; such ends are provided with mating surfaces to provide a substantially continuous flux path. Coil windings 83 are placed, before assembly, so as to be disposed in the space provided between the center posts and skirts of the two core elements 57, 60.

Distal end 84 of center post 78 and distal end 50 of the center post 38 of core part 57 are in axially spaced relationship forming air gap 86.

Core elements 57 and 60 are held, as shown in FIG. 6, by spring-loaded retaining clip 85. The retaining clip selected allows access to slot 74 for rotation of the male tuning adjustment member 67 and also freedom of axial movement of shaft 68 at the longitudinally opposite end of the male tuning adjustment member 67. Legs 87, 88 are provided for mounting the assembly on a circuit board. Spring-loaded retainer clips and their operation are well known in the art; suitable retainer clips are commercially available, for example from Spang Industries Inc., Butler, Pa. 16001.

Ferrite sleeve 72 is fixedly mounted on the non-magnetic shaft portion of male tuning member 67 so that rotation of member 67 moves ferrite sleeve 72 axially to adjust air gap 86.

The external threads 70 on shaft 68 engage and cooperate with the internal threads 56 of unitary core element 57 to provide such axial movement of ferrite slug 72.

Head 66 interfits with wall 64, providing a frictional fit, so that the male tuning member 67 is stabilizied at both its longitudinal ends. The embodiment of FIG. 6 provides compatibility with male tuning members conventionally used in the prior commercial practice.

The invention includes additional teachings which further reduce the number of parts required, and further simplify manufacture and assembly.

In the tunable-inductance magnetically soft ferrite core assembly 90 of FIG. 7, two core halves 92, 94 are molded with a uniform cross-sectional center opening through each. Prior to sintering, threads 96 are formed in the green compact of ferrite part 92 contiguous to outer opening 98. Core element 92 and unitary threads 96 are hardened to a ceramic state by sintering. Male tuning member 100 carries ferrite slug 102 fixedly mounted at the distal end of externally-threaded non-magnetic head portion 104. The ferrite slug 102 is inserted through the threaded core part 92 and its position adjusted by coaction of the external threads on the head portion 104 with the unitary threads 96 on the center opening wall. In this embodiment, male tuning member 100 is held by threads at the head portion longitudinal end.

To further facilitate assembly and minimize inventory of differing types of core elements (half sections), the invention teaches threading of both core sections as shown in FIG. 8. Threads are tapped along the wall of the central opening of both core elements before sintering. Core element 106 with internal threads 108 is substantially identical to core element 92 so that only one type of core element (half section) need be inventoried. Assembly is simplified since the male tuning member 100 (as described in relation to FIG. 7) can be inserted into either core element.

In the embodiment of FIG. 9, the core elements 109, 110, with substantially identical central openings, are tapped before sintering to have, respectively, counterbore portions 112, 114 and threaded portions 116, 118; such threaded portions are contiguous to the distal ends of center posts 120, 122. When a male tuning element of the type shown in FIGS. 7 and 8 is utilized, the ferrite slug 102 can further be provided with a slightly tapered sidewall near its distal end to facilitate adjustment and tuning.

A differing embodiment of the male tuning member is illustrated in FIG. 9 to provide support at both its longitudinal ends while enabling use of the same type of core element for both cOre halves. Male tuning member 124 is shown (in broken lines) before assembly, and after assembly in FIG. 9.

Male tuning member 124 includes externally-threaded head portion 129, shaft 128 on which ferrite sleeve 130 is mounted, and retainer 132 which carries flat plastic washer 134; the latter having a rectangular configuration, or other configuration, so that symmetrically distributed peripheral protrusions interfit with threads 118, as shown in assembled form in FIG. 9, to provide longitudinal stability at the end opposite to head portion 129.

Magnetically soft ferrites are formed from iron oxide and metal oxides of at least one other bivalent metal. Manganese zinc ferrite cores are typically used in telecommunication circuitry. A representative composition for such a ferrite core is:

about 50 mole % $Fe_2O_3$, about 2 to 9 mole % FeO, about 31 to 36 mole % MnO, and about 10 to 15 mole % ZnO. Conventional additives such as calcium carbonate, silicon dioxide, titanium dioxide, and tin oxide can be used. When used, such additives are made in such small percentages that they do not significantly alter the basic composition as disclosed in the patent to Goldman et al. No. 4,097,392. The composition of the ferrite slug is selected from known ferrite compositions to provide desired magnetic properties for adjustment of the air gap. Various suitable ferrite compositions are known to those skilled in this art; suitable ferrites can be obtained commercially from, e.g., Spang Industries Inc., Butler, Pa. 16001.

Materials having ferrimagnetic properties for pressing of the core parts can be prepared by either dry or wet processes, both of which are known in the art. After providing the desired composition, the material is calcined between about 600° C. and about 1000° C. Factors affecting residual reactivity include the nature of the ferrimagnetic material and the temperature and rate of calcining.

The material is processed in fine particulate form and compacted, generally with an average particle size of about 200 mesh, at pressures between about fifteen and thirty tons/in$^2$ (about 2000 to 4000 Kg/cm$^2$). A binder such as polyvinyl alcohol is used at about 2% to 3% by weight. Such ferrite porcessing steps and materials are well known to those skilled in the art.

In accordance with the invention, after compaction, threads are formed in the center opening wall of the unitary green compact, before sintering, using a shrink tap. The dimensions of the threads formed in the green compact are selected to provide threads in the sintering product within desired specifications enabling use of commercial male tuning members with standardized threads. The shrink tap is dimensioned accordingly to compensate for shrinkage during sintering. The tap is formed with longitudinally extending flutes, between thread cutting segments in its periphery, as shown in FIG. 5, to provide for removal of ferrimagnetic material during threading. Standardized core sizes and dimensions are well known in the art as well as thread characteristics from the prior art male member and separately formed female member.

The binder for the ferrimagnetic particles generally comprises about 7% to 10% by volume; with the small particle sizes involved, tapping of the green compact to desired specifications can be readily carried out. The shrink tap provides about 15% shrinkage when using a manganese-zinc ferrimagnetic material, as set forth above. Shrinkage values for other ferrite compositions are readily available to those skilled in the art.

The unitary green compact is sintered at about 1200° C. to 1400° C. for one to four hours in high nitrogen content (90%–95%) gas and then cooled at estabilished rates, e.g. with equilibrium control of oxygen as described in the Blank U.S. Pat. No. 3,027,327. After sintering, the ceramic part exhibits hardness characteristics in the range of eighty-five to ninety-five on the Rockwell "C" hardness scale.

In light of the above teachings, various other configurations than shown, and ferrite materials other than those described, can be used by those skilled in the art while relying on basic concepts of the invention; therefore, in determining the scope of the present invention, reference should be made to the appended claims.

I claim:

1. Method for manufacturing a magnetically-soft ferrite core part to provide unitary means for accurately adjusting the inductance of an electrical inductance device which includes such core part, comprising providing a substantially homogeneous mass of particulate ferrimagnetic material which is reactive when treated at elevated temperatures to form a magnetically-soft ceramic ferrite, molding such ferrimagnetic material at elevated pressure to form a unitary greem compact, such green compact including an elongated center post symmetrically distributed about a centrally located longitudinal axis, a web portion extending in transverse relationship to such axis contiguous to one longitudinal end of such center post, and a skirt portion extending from such web in spaced relationship from such center post and extending in an axial direction to define a space for receiving coil windings between such center post and such skirt portion, such center post defining a central opening extending longitudinally with and substantially symmetrically about such longitudinal axis, such central opening presenting interior wall surface means of circular cross section in a plane transverse to such longitudinal axis, such interior wall surface means including a wall surface portion of reduced diameter with respect to the remainder of such interior wall surface means, such reduced diameter wall surface portion being established during pressure compaction and being contiguous to such one longitudinal end of the center post from which such web portion extends, forming unitary helical threads solely in such reduced diameter portion of the central opening interior wall surface means, such helical threads being formed in such reduced diameter portion of such interior wall surface means of such pressure molded unitary green compact, and thereafter sintering such green compact at elevated temperature to form a ceramic core part with unitary helical threads established along at least a predetermined portion of its central wall surface means extending longitudinally along its central opening within its center post for receiving an externally-threaded nonmagnetic portion of an elongated male tuning member when such tuning member is inserted axially into such central opening, such externally-threaded nonmagnetic portion of such male tuning member presenting threads of predetermined specifications, the unitary helical threads in such portion of the central opening wall surface means of the pressure molded unitary green compact being formed with predetermined specifications to compensate for shrinkage of such unitary green compact during sintering so as to accommodate such threads of predetermined specifications presented by such externally-threaded nonmagnetic portions of such male tuning member.

2. A magnetically-soft ferrite pot core part produced in accordance with the method of claim 1.

3. A magnetically-soft ferrite pot core assembly with adjustable air gap comprising, in combination, a pair of unitary core elements adapted to be assembled in contacting relationship, each such core element being formed from a single substantially homogeneous mass of ferrite material and including a center post symmetrical about a centrally located axis, a web extending from one end of the center post in transverse relation to such axis, and a skirt extending from the web in spaced relation to the center post defining a space for coil windings between the center post and the skirt, each skirt terminating in a mating surface for contacting the corresponding mating surface on the other core element skirt, the center post of each core element terminating in a distal surface with such distal surfaces being spaced axially from one another to define an air gap when the mating surfaces on the skirts of the pair of core elements are in contacting relationship, each center post defining a central opening, symmetical about its centrally located axis, extending through the center post and presenting wall surface means, such central openings being in axial alignment when the pair of core elements are assembled, the central opening in the center post of one of the pair of core elements including two axially aligned cylindrical sections of unequal diameter with the cylindrical section of larger diameter being located contiguous to the longitudinal end of such center post terminating in such distal surface, unitary helical threads located in the remaining cylindrical section wall surface of smaller diameter which is located contiguous to the remaining longitudinal end of the center post from which such web portion extends, and an elongated male tuning member including magnetic material and nonmagnetic material, such male member being insertable axially within such axially alinged central openings to permit rotation about its central axis to adjust the magnetic characteristics of such air gap, the elongated male tuning member including a nonmagnetic head portion of circular cross section in a plane transverse to its longitudinal axis, such head portion being located at one longitudinal end of such male tuning member, a nonmagnetic shaft portion of circular cross section in a plane transverse to its longitudinal axis, such shaft portion being of smaller diameter than such head portion and being located at the remaining longitudinal end of such male tuning member, such shaft portion including helical threads of predetermined specifications on its exterior periphery contiguous to such remaining longitudinal end of such male tuning member, the magnetic material of the elongated male tuning member comprising a ferrite tuning slug having a cylindrical exterior configuration, such tuning slug being axially aligned with and held between such head portion and such remaining longitudinal end of the elongated male tuning member, thecentral opening in the remaining core element of such pair of core elements presenting throughout its axial length a thread-free cylindrical wall surface having a uniform diameter corresponding dimensionally to the diameter of the head portion of the elongated tuning member to provide frictional contact between such head portion and such thread-free cylindrical surface of such remaining core element, such that the elongated male tuning member is held at one of its longitudinal ends by such head portions contacting such thread-free cylindrical surface of such remaining core element and is held at its opposite longitudinal end upon rotation of such male tuning member by cooperative engagement of such helical threads on such shaft portion of the elongated male tuning member with such unitary helical threads in such smaller diameter cylindrical wall surface of the core element having two cylindrical central opening sections of unequal diameter.

* * * * *